US012453881B2

(12) United States Patent
Zhang

(10) Patent No.: US 12,453,881 B2
(45) Date of Patent: Oct. 28, 2025

(54) WEIGHT-BEARING BRACELET

(71) Applicant: Dequan Zhang, Wanyuan (CN)

(72) Inventor: Dequan Zhang, Wanyuan (CN)

( * ) Notice: Subject to any disclaimer, the term of this patent is extended or adjusted under 35 U.S.C. 154(b) by 169 days.

(21) Appl. No.: 18/415,788

(22) Filed: Jan. 18, 2024

(65) Prior Publication Data

US 2025/0099800 A1 Mar. 27, 2025

(30) Foreign Application Priority Data

Sep. 26, 2023 (CN) ..... 202322641573.X

(51) Int. Cl.
*A63B 21/065* (2006.01)
*A44C 5/00* (2006.01)
*A44C 5/10* (2006.01)

(52) U.S. Cl.
CPC ..... *A63B 21/065* (2013.01); *A44C 5/0023* (2013.01); *A44C 5/105* (2013.01); *A63B 2225/09* (2013.01)

(58) Field of Classification Search
CPC ..... A63B 21/065; A63B 2225/09; A63B 2071/0694; A63B 2209/08; A63B 2209/10; A63B 21/00065; A63B 21/4021; A63B 23/12; A44C 5/0023; A44C 5/105; A44C 5/2052; A44C 5/2076; A44C 5/0007; E05B 15/04
See application file for complete search history.

(56) References Cited

U.S. PATENT DOCUMENTS

| | | | | |
|---|---|---|---|---|
| 7,856,805 | B2 * | 12/2010 | Hostettler | A44C 5/105 63/3 |
| 11,921,471 | B2 * | 3/2024 | Bailey | G04G 21/08 |
| 12,290,712 | B2 * | 5/2025 | D'Ambrosio-Correll | A63B 21/0607 |
| 2019/0302837 | A1 * | 10/2019 | Liao | A44C 5/0053 |
| 2020/0253340 | A1 * | 8/2020 | Valenti | A44C 5/0007 |
| 2020/0275895 | A1 * | 9/2020 | Barachant | G06N 20/00 |
| 2023/0135228 | A1 * | 5/2023 | D'Ambrosio-Correll | A63B 21/065 482/105 |

FOREIGN PATENT DOCUMENTS

| | | | | |
|---|---|---|---|---|
| CN | 113694461 A | * | 11/2021 | A63B 21/065 |
| CN | 220937036 U | * | 5/2024 | E05B 15/04 |
| EP | 3919141 A1 | * | 12/2021 | A63B 21/0605 |
| RU | 227529 U1 | * | 7/2024 | |

* cited by examiner

*Primary Examiner* — Andrew M Kobylarz

(57) ABSTRACT

A weight-bearing bracelet, including a bracelet body. An end of the bracelet body is arranged with a first docking mechanism, and the other end is arranged with a docking member; the first docking mechanism includes a docking groove and a locking assembly; the locking assembly includes a locking member and a resilient member; the locking member is arranged with a first limiting portion; the docking member includes a first docking member capable of being inserted into the docking groove, and the first docking member is arranged with a second limiting portion; the second limiting portion is located on a rear side of the first limiting portion, to restrict the first docking member from being disengaged from the docking groove, in condition of the first docking member being inserted into the docking groove.

14 Claims, 10 Drawing Sheets

WEIGHT-BEARING BRACELET

CROSS REFERENCE

The present disclosure claims priority of Chinese Patent Application No. 202322641573. X, filed on Sep. 26, 2023, the entire contents of which are hereby incorporated by reference in their entirety.

TECHNICAL FIELD

The present disclosure relates to a weight-bearing bracelet.

BACKGROUND

Chinese Patent No. CN219501930U discloses a weight-adjustable weight-bearing bracelet including a weight-bearing part and a connection part; the weight-bearing part is arranged with multiple weight-bearing units, and a gap exists between each adjacent weight-bearing units; each weight-bearing unit includes a holding space, a weight-bearing block, and an opening, the weight-bearing block being located in the holding space and being removable from the opening. The connection part is configured to be connected to the weight-bearing part such that the weight-bearing bracelet can be strapped to an arm of an exerciser. Since the weight-bearing block can be taken out or put in from the openings, the exerciser can put in a corresponding number of weight-bearing blocks according to his/her strength and exercise requirements, and thus the weight-bearing bracelet can be applicable to different people. However, the operation of the connection part of the above-mentioned weight-bearing bracelet is troublesome, it is impossible to realize rapid disassembly and installation, and the service life of this connection structure is short.

It is also possible to adopt a Velcro structure which is widely used in the market, and the Velcro structure can realize rapid disassembly. However, the stability of this connection structure is poor, and it is easy to fall off in the process of movement.

SUMMARY OF THE DISCLOSURE

The purpose of the present disclosure is to provide a weight-bearing bracelet with a reliable and more durable connection structure.

A weight-bearing bracelet, including a bracelet body; wherein an end of the bracelet body is arranged with a first docking mechanism, and the other end of the bracelet body is arranged with a docking member; the first docking mechanism includes a docking groove and a locking assembly; the locking assembly includes a locking member and a resilient member; the locking member is movably disposed between a locked position and a released position in the docking groove, and the resilient member is configured to drive the locking member to move to the locked position; the locking member is arranged with a first limiting portion; the docking member includes a first docking member capable of being inserted into the docking groove, and the first docking member is arranged with a second limiting portion; the second limiting portion is located on a rear side of the first limiting portion, to restrict the first docking member from being disengaged from the docking groove, in condition of the first docking member being inserted into the docking groove. The above technical scheme may make the connection more stable, less likely to fall off, and more durable, compared with the Velcro connection commonly found on the market.

The locking member is movable in a width direction of the bracelet body; the locking member includes a main body extending in the width direction of the bracelet body, the first limiting portion is formed on the main body and protrudes out from upper and lower sides of the main body; the first docking member includes an upper docking plate and a lower docking plate, the upper docking plate being arranged at an interval and opposite to the lower docking plate; the second limiting portion is formed on surfaces of the upper docking plate and the lower docking plate that faces each other; the main body and the second limiting portion are located between the upper docking plate and the lower docking plate, in condition of the first docking member being inserted into the docking groove. The above technical scheme may make the connection more stable, due to the fact that the first limiting portion and the second limiting portion can be coordinated such that the docking member is restricted from being disengaged from the docking groove after the docking member is inserted into the docking groove.

The main body of the locking member is further formed with a limit block adapted to the docking groove, and the limit block is configured to restrict the locking member to only move between the locked position and the released position but not rotate; each of the upper docking plate and the lower docking plate defines a notch that avoids the limit block. The notches are provided such that the upper docking plate and the lower docking plate can still be inserted into the docking groove even with the limit block.

The notches separate front ends of the upper docking plate and the lower docking plate into unevenly spaced segments. This serves to differentiate between front and rear ends, and makes it easier for the user to correspond the docking member with the docking groove and insert the docking member into the docking groove.

The first docking mechanism includes a docking seat for defining the docking groove; an end of the locking member is formed with a first guide rod extending in a moving direction of the locking member, and another end of the locking member is formed with a second guide rod extending in the moving direction; the docking seat defines two guide holes for the first guide rod and the second guide rod to pass through; the first guide rod extends through a corresponding guide hole to an outer side of the docking seat, in condition of the locking member being in the locked position; the locking member is driven to move to the released position by the first guide rod being pressed. Such a setting may facilitate that the user can quickly remove the weight-bearing bracelet at any time by pressing the first guide rod to disengage the docking member from the docking seat.

The locking member is further arranged with a third limiting portion, and the resilient member is a coil spring sleeved on the second guide rod; the coil spring is compressed between the third limiting portion and an inner wall of the first docking groove. An end of the spring abuts against the inner wall of the docking groove, and the other end of the spring abuts against the third limiting portion, such that the first guide rod can be provided with a force to penetrate the guide hole, thereby the first guide rod can stably penetrate the guide hole in a state of not being pressed.

The other end of the bracelet body is further arranged with a second docking mechanism, and the docking member further includes a second docking member capable of being inserted into and cooperating with the second docking mechanism; the second docking member has a same structure as the first docking member, and the second docking mechanism has a same structure as the first docking mechanism.

The first docking member and the second docking member are articulated with each other by means of an articulation shaft, the articulation shaft extending along a width direction of the bracelet body. This articulation structure may enable the first docking member and the second docking member to be oscillated along the articulation shaft, such that it is convenient for the user to adjust the shape and the angle of the weight-bearing bracelet.

The bracelet body includes a band body and a plurality of weight-bearing blocks sleeved on the band body.

The first docking mechanism further includes a first docking seat for defining the docking groove; the first docking seat is connected to an end of the band body; the end of the band body is arranged with a restriction rod extending along a width direction of the band body, an end of the first docking seat defines the docking groove, and another end of the first docking seat defines an avoidance hole in communication with the docking groove; a length of the avoidance hole is adapted to a width of the band body, and a length of the restriction rod is greater than the width of the band body. In this way, the end of the band body can be penetrated into an interior of the first docking seat through the avoidance hole, and the band body cannot be disengaged from the first docking seat under an action of the restriction rod.

The second docking mechanism includes a second docking seat for defining the docking groove; the second docking seat is arranged with two adjusting rods each extending along a width direction of the bracelet body; the two adjusting rods are arranged in parallel and spaced, and the band body is adjustably wound on the two adjusting rods. The other end of the band body can be passed through one of the two adjusting rods and then be wound back and passed through the other of the two adjusting rods, such that the length of the band body can be adjusted. Different users can adjust according to their own situation.

A length direction of the docking groove extends along a width direction of the bracelet body; a width direction of the docking groove extends along a thickness direction of the bracelet body; a size of the first docking member and a size of the docking groove are adapted to match.

A cross-section of the docking groove is substantially trapezoidal in shape. The trapezoidal shape can play a certain guiding role for the insertion of the docking member into the docking groove.

The first limiting portion is formed with a guiding bevel, and the second limiting portion is capable of being guided by the guiding bevel to the rear side of the first limiting portion. The provision of the guiding bevel may reduce the resistance of the second limiting portion moving to the rear side of the first limiting portion, thereby making the assembly of the weight-bearing bracelet quicker.

DETAILED DESCRIPTION

Figure 1:
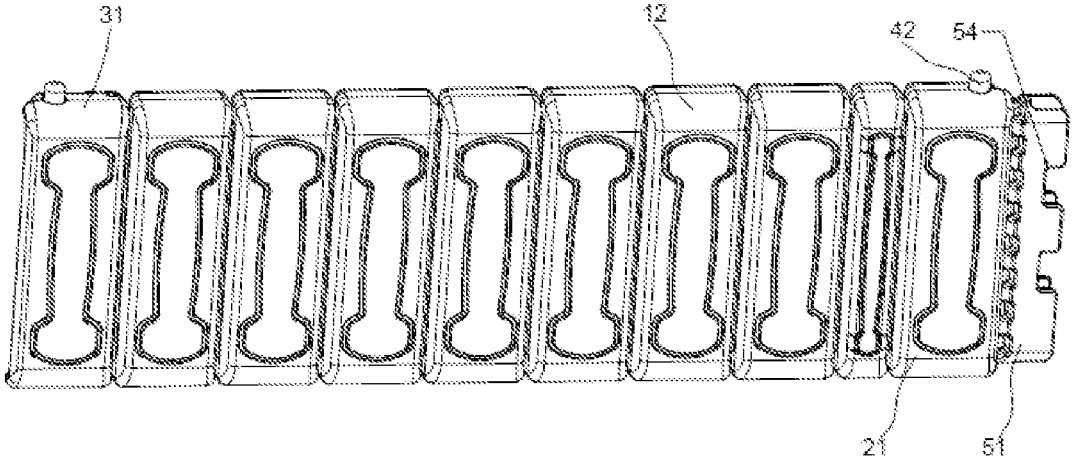
FIG. 1 is a perspective view of a weight-bearing bracelet in a disassembled state according to Embodiment I of the present disclosure.
Figure 2:
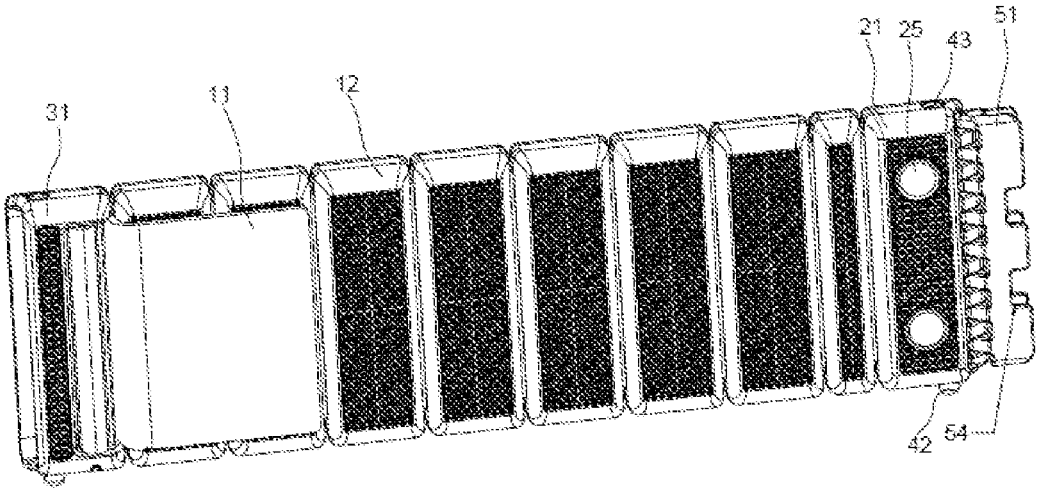
FIG. 2 is a perspective view of a weight-bearing bracelet in a disassembled state according to Embodiment I of the present disclosure from another viewing angle.
Figure 3:
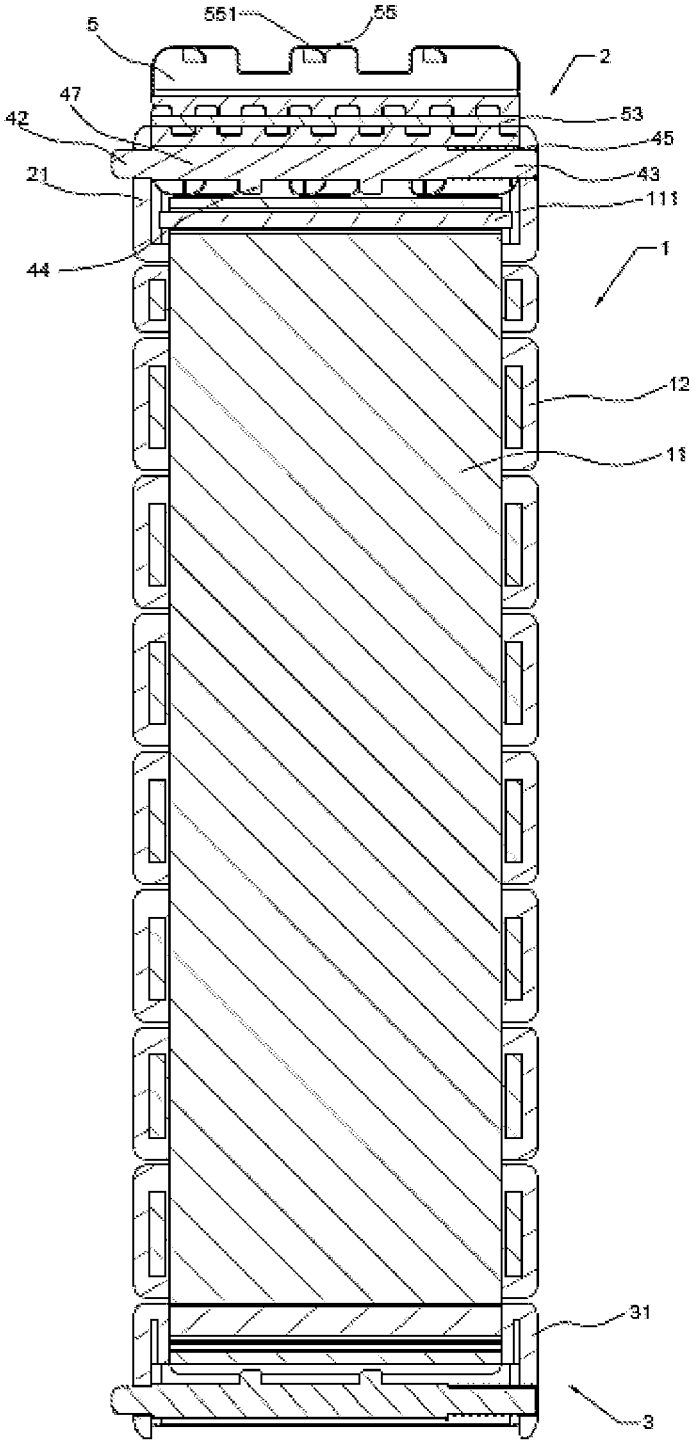
FIG. 3 is a sectional view of a weight-bearing bracelet according to Embodiment I of the present disclosure.
Figure 4:
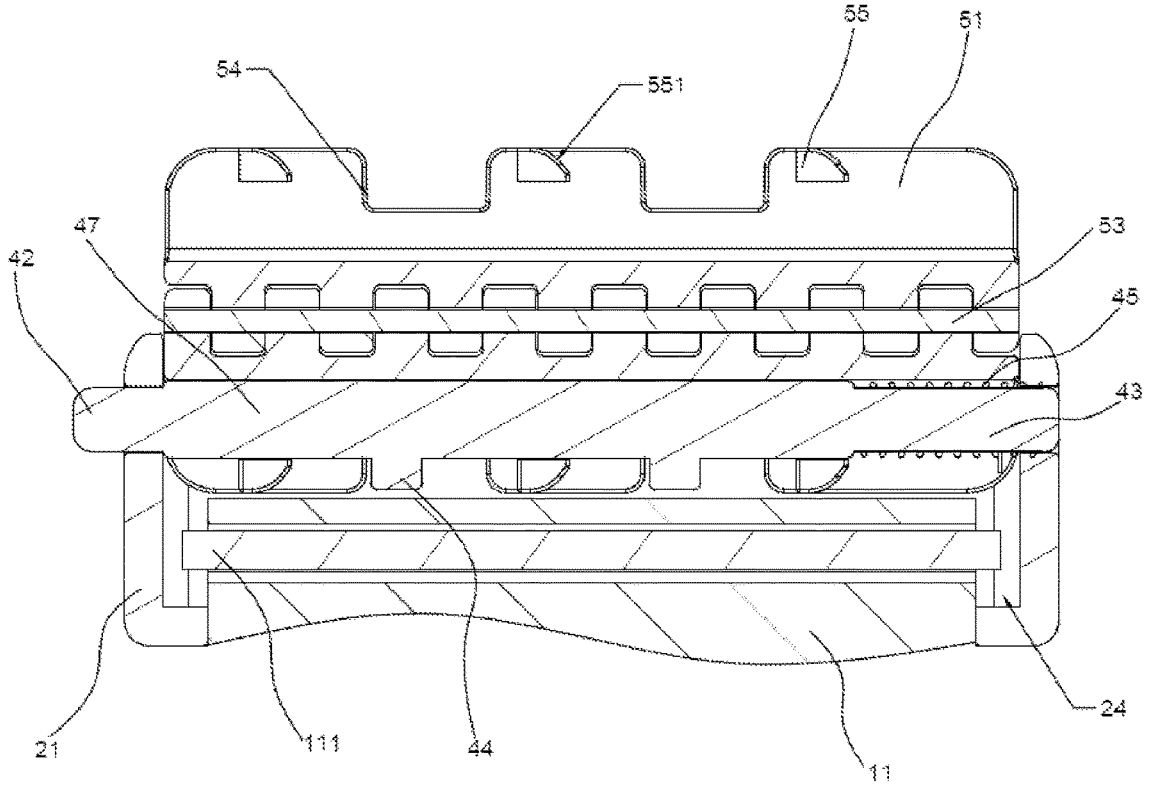
FIG. 4 is a partially enlarged view of FIG. 3.
Figure 5:
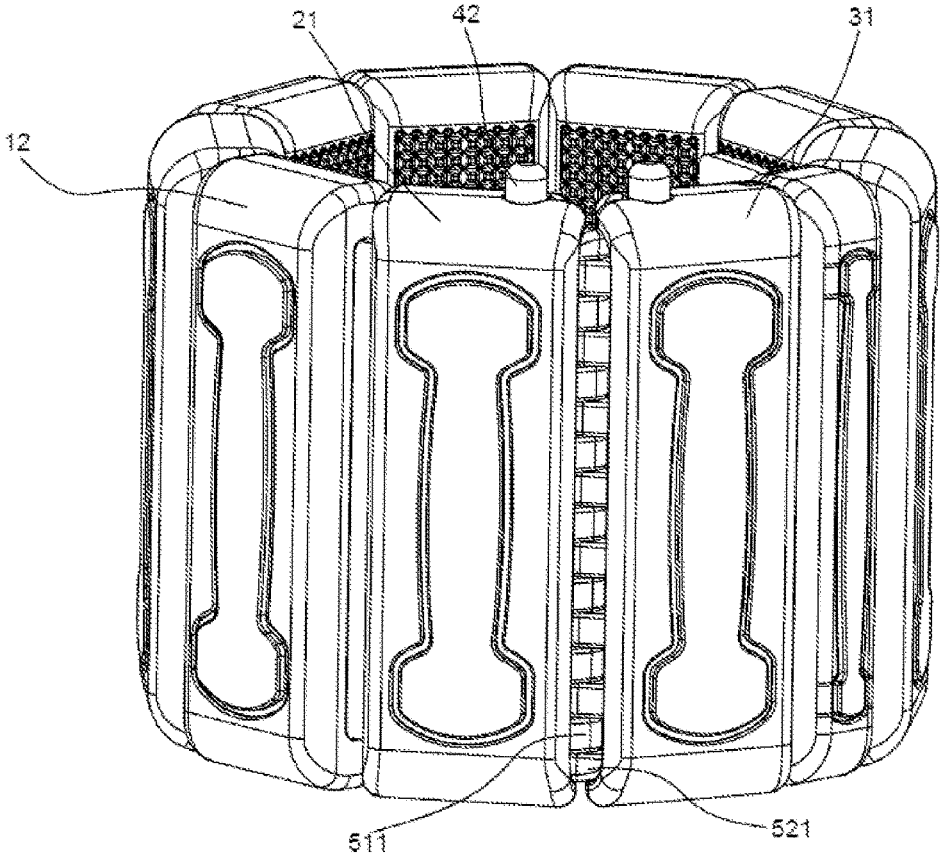
FIG. 5 is a perspective view of a weight-bearing bracelet in a connected state according to Embodiment I of the present disclosure.
Figure 6:
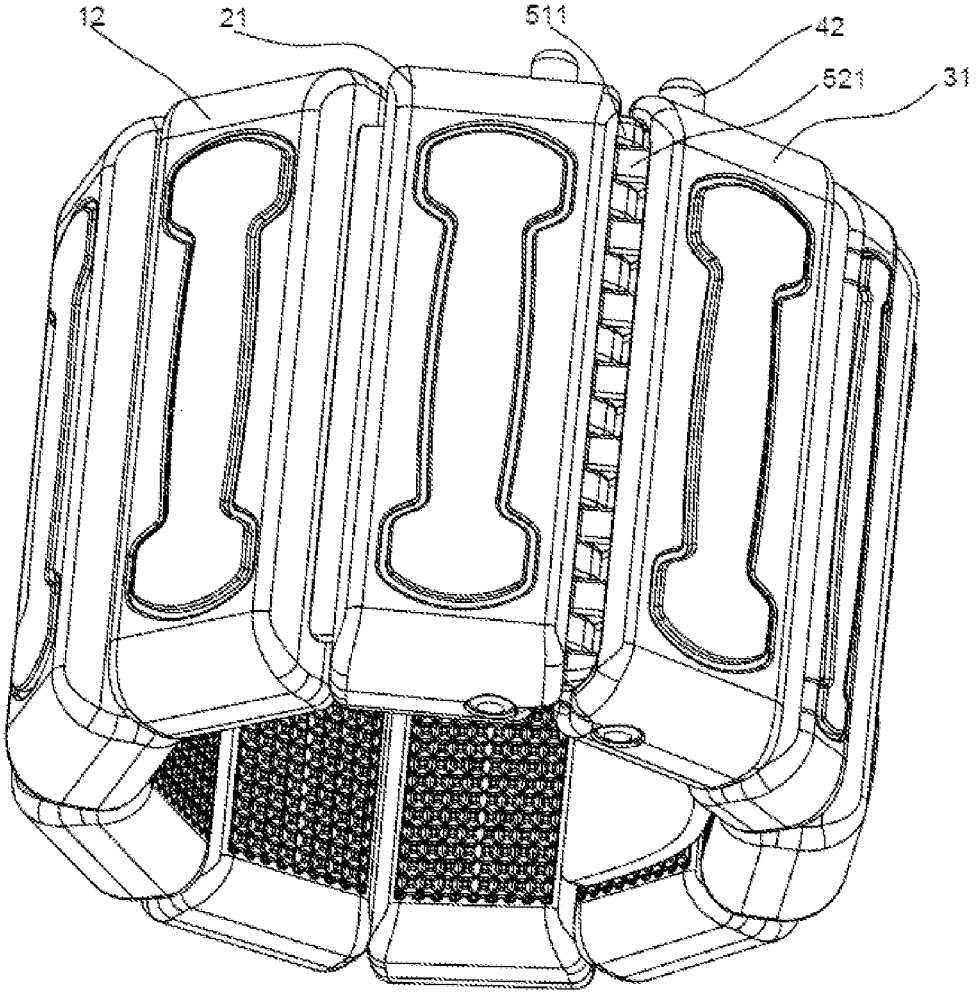
FIG. 6 is a perspective view of a weight-bearing bracelet in a connected state according to Embodiment I of the present disclosure from another viewing angle.
Figure 7:
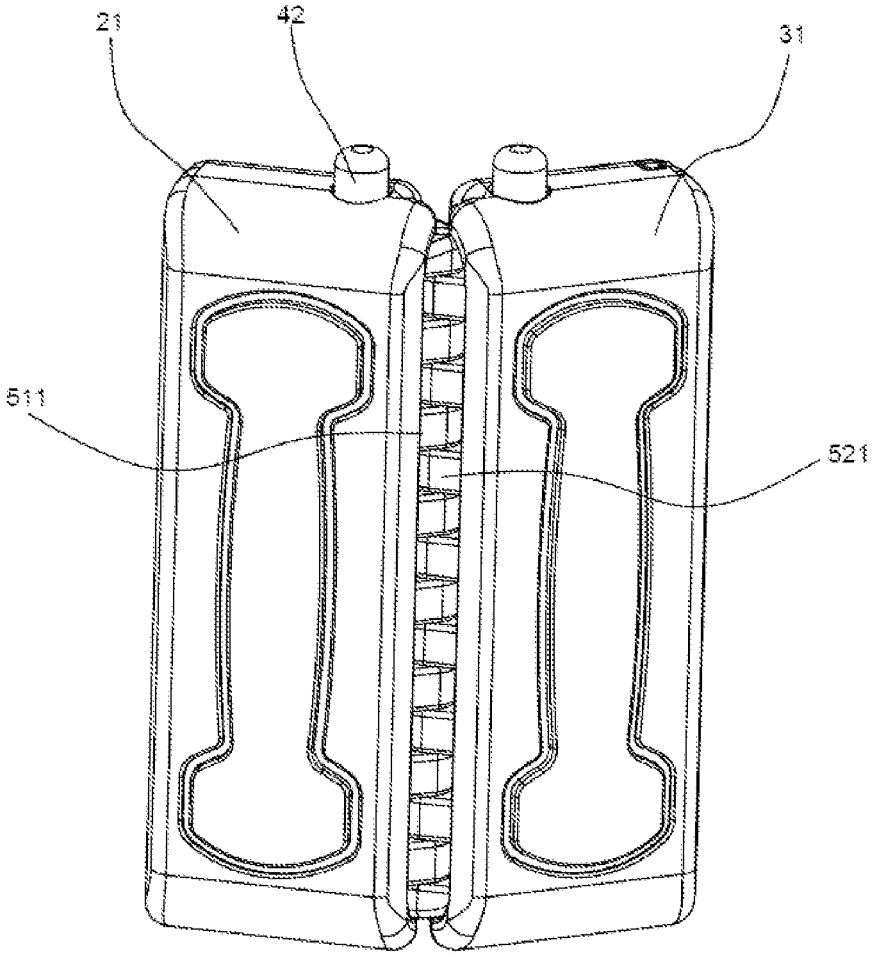
FIG. 7 is a schematic view of a connection between a first docking mechanism, a docking member, and a second docking mechanism according to the present disclosure.
Figure 8:
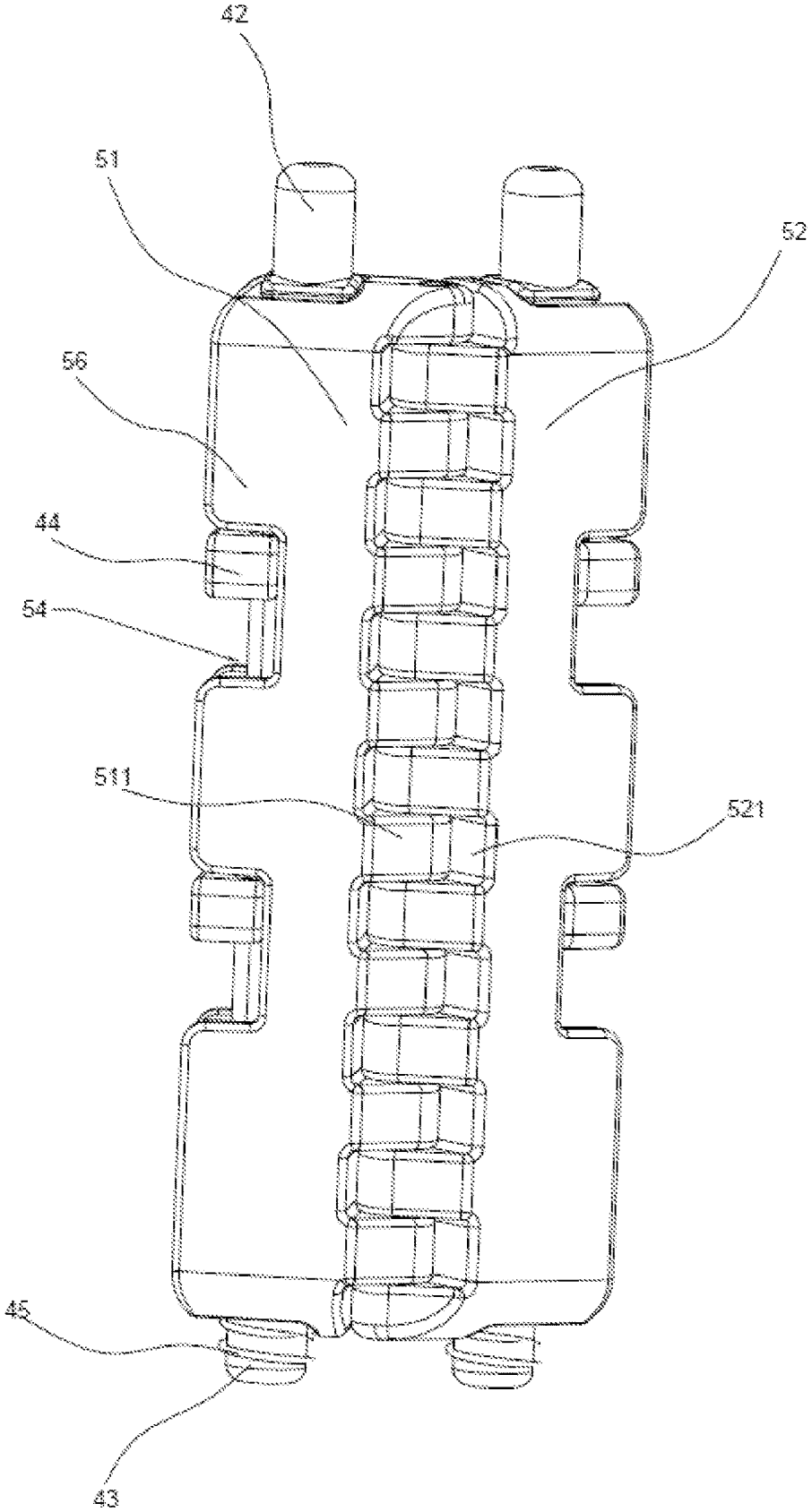
FIG. 8 is a schematic view of a connection between a docking member and a locking member according to the present disclosure.
Figure 9:
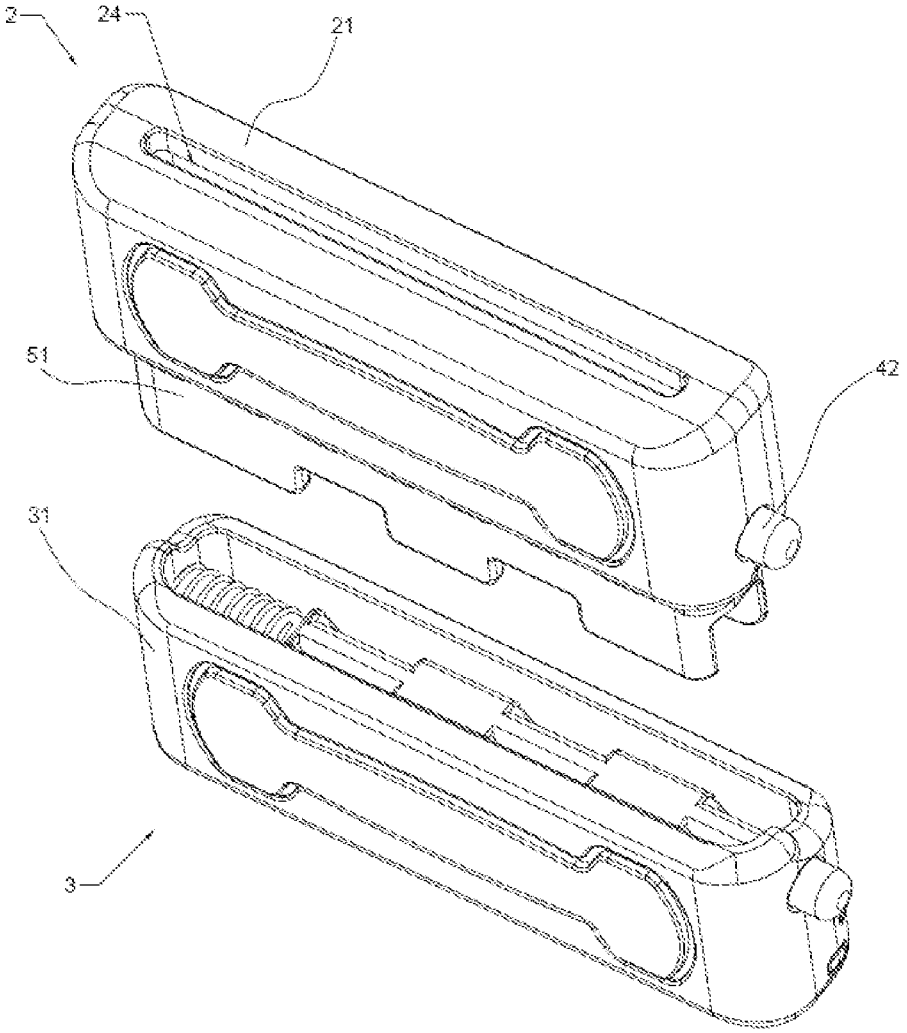
FIG. 9 is a structural schematic view of a first docking mechanism, a docking member, and a second docking mechanism according to the present disclosure.
Figure 10:
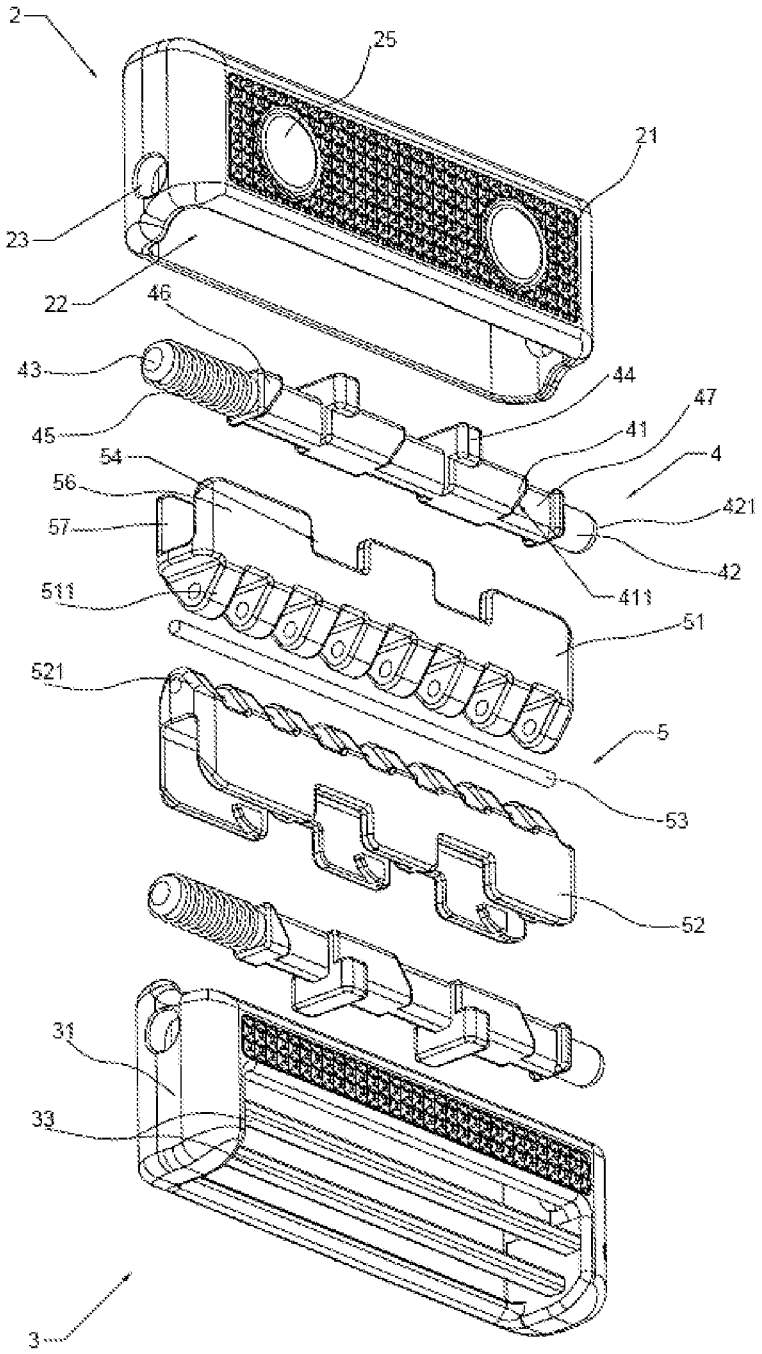
FIG. 10 is a disassembled view of FIG. 9.
Figure 11:
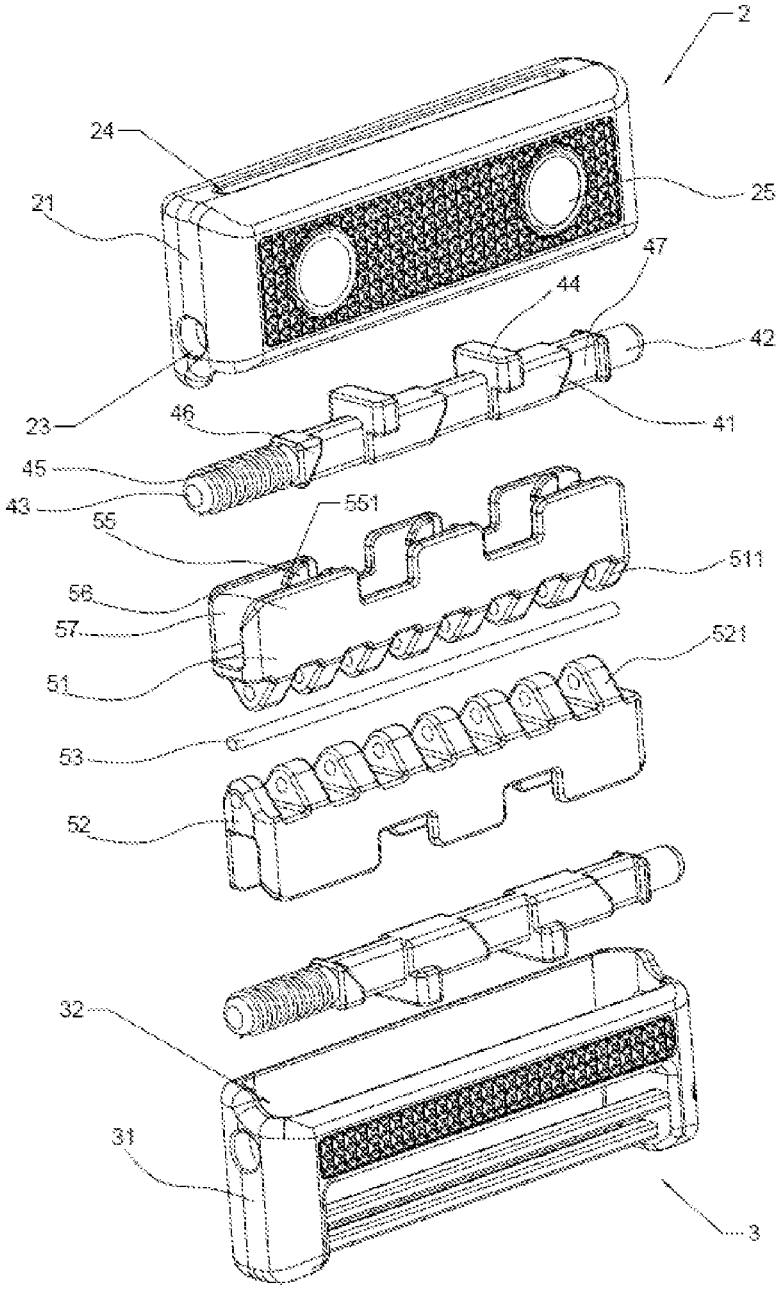
FIG. 11 is a disassembled view of FIG. 9 from another viewing angle.

Embodiment I: with reference to FIGS. 1 to 11, a weight-bearing bracelet includes a bracelet body 1; the bracelet body 1 includes a band body 11 and multiple weight-bearing blocks 12 sleeved on the band body 11, where the band body 11 may be a woven fabric or elastic band, and each weight-bearing block 12 is substantially rectangular in shape extending in a width direction of the band body 11; each weight-bearing block 12 defines an elongated hole extending along a length direction of the weight-bearing block 12; a width of the band body 11 is less than the length of each weight-bearing block 12, and a length of the elongated hole is substantially the same as the width of the band body 11; the band body 11 passes through multiple weight-bearing blocks 12 in sequence to connect the multiple weight-bearing blocks 12 together in series; each weight-bearing block 12 includes a silicone outer shell and a metal inner core wrapped by the silicone outer shell. Because the silicone has a certain degree of elasticity and a softer feel, a certain degree of cushioning will be generated when the user's skin is in contact with the weight-bearing blocks 12, which may improve comfort.

An end of the bracelet body 1 is arranged with a first docking mechanism 2, and the other end of the bracelet body 1 is arranged with a second docking mechanism 3; the first docking mechanism 2 includes a first docking seat 21 and a locking assembly, where the first docking seat 21 is connected to an end of the band body 11; the end of the band body 11 is arranged with a restriction rod 111 extending along the width direction of the band body 11, an end of the first docking seat 21 defines a first docking groove 22, and another end of the first docking seat 21 defines an avoidance hole 24 in communication with the first docking groove 22; a length of the avoidance hole 24 is adapted to the width of the band body 11, and a length of the restriction rod 111 is greater than the width of the band body 11, such that the end of the band body 11 can be penetrated into an interior of the first docking seat 21 through the avoidance hole 24, and the band body 11 cannot be disengaged from the first docking seat 21 under an action of the restriction rod 111; the second docking mechanism 3 includes a second docking groove 32 and a second docking seat 31 defining the second docking groove 32, and the second docking seat 31 is arranged with two adjusting rods 33 each extending along a width direction of the bracelet body 1; the two adjusting rods 33 are arranged in parallel and spaced; the band body 11 is adjustably wound on the two adjusting rods 33, and the other end of the band body 11 can be passed through one of the two adjusting rods 33 and then be wound back and passed through the other of the two adjusting rods 33, such that the band body 11 can be fixed in the two adjusting rods 33 and the length of the band body 11 can be adjusted. Different users can adjust according to their own situation. A side of the first docking seat 21 configured to contact the human body may be arranged with a round magnet 25, which may generate a certain magnetic therapy effect when the bracelet is worn on the human body.

The first docking mechanism 2 is connected to the second docking mechanism 3 through a docking member 5, thereby connecting the two ends of the bracelet body 1 into a ring; the docking member 5 includes a first docking member 51 that can be inserted into the first docking groove 22 and a second docking member 52 that can be inserted into the second docking groove 32, and the locking assembly includes a locking member 4 and a resilient member 45; the locking member 4 may be movably disposed between a locked position and a released position in the first docking groove 22 and the second docking groove 32, and the resilient member 45 is configured to drive the locking member 4 to move to the locked position; the locking member 4 is arranged with a first limiting portion 41, and the first docking member 51 is arranged with a second limiting portion 55; the second limiting portion 55 is located on a rear side of the first limiting portion 41 to restrict the first docking member 51 from being disengaged from the first docking groove 22 after the first docking member 51 is inserted into the first docking groove 22. The above technical scheme may realize rapid insertion and removal of the two ends of the bracelet, which is efficient and convenient, and make the connection more stable and less likely to fall off compared with the Velcro connection commonly found on the market.

A length direction of the first docking groove 22 and a length direction of the second docking groove 32 extend along the width direction of the bracelet body 1. A width direction of the first docking groove 22 and a width direction of the second docking groove 32 extend along a thickness direction of the bracelet body 1. A size of the first docking member 51 and a size of the first docking groove 22 are adapted to match, such that the first docking member 51 and the first docking groove 22 can be better matched; and a size of the second docking member 52 and a size of the second docking groove 32 are also adapted to match. The first docking groove 22 and the second docking groove 32 are each substantially trapezoidal in cross-section, and the trapezoidal shape can play a certain guiding role for the insertion of the docking member 5 into the first docking groove 22 and the second docking groove 32.

The locking member 4 is movable in the width direction of the bracelet body 1; the locking member 4 includes a main body 47 extending in the width direction of the bracelet body 1, the first limiting portion 41 is formed on the main body 47 and protrudes out from upper and lower sides of the main body; the first docking member 51 includes an upper docking plate 56 and a lower docking plate 57, the upper docking plate 56 being arranged at an interval and opposite to the lower docking plate 57; the second limiting portion 55 is formed on surfaces of the upper docking plate 56 and the lower docking plate 57 that faces each other. When the first docking member 51 is inserted into the first docking groove 22, the main body 47 and the second limiting portion 55 are located between the upper docking plate 56 and the lower docking plate 57, such that the first limiting portion 41 and the second limiting portion 55 can be coordinated such that the docking member 5 is restrained from disengaging from the first docking groove 22 when the docking member 5 is inserted into the first docking groove 22, so as to make the connection more stable. The first limiting portion 41 is formed with a guiding bevel 411, and the second limiting portion 55 is formed with an arcuate surface 551; the arcuate surface 551 can better cooperate with the guiding bevel 411, such that the second limiting portion 55 can be guided by the guiding bevel 411 to the rear side of the first limiting portion 41, and the provision of the guiding bevel 411 can reduce the resistance of the second limiting portion 55 moving to the rear side of the first limiting portion 41.

An end of the locking member 4 is formed with a first guide rod 42 extending in a moving direction of the locking member 4, and another end of the locking member 4 is formed with a second guide rod 43 extending in the moving direction; the first docking seat 21 defines a guide hole 23 for the first guide rod 42 and the second guide rod 43 to pass through; when the locking member 4 is in the locked position, the first guide rod 42 extends through the guide hole 23 to an outer side of the first docking seat 21, and a portion of the first guide rod 42 extending to the outer side forms a pressing portion 421, such that the locking member 4 can be driven to move to the released position by pressing the pressing portion 421, which may be convenient for the user to quickly remove the weight-bearing bracelet at any time by pressing the pressing portion 421 and disengaging the docking member 5 from the first docking seat 21. When the locking member 4 is in the released position, the second guide rod 43 extends through the guide hole 23 to the outer side of the first docking seat 21. The main body 47 of the locking member 4 is further formed with a limit block 44 adapted to the first docking groove 22, the limit block 44 having a rectangular cross-section and the main body 47 of the locking member 4 having a substantially circular cross-section, and the limit block 44 abutting against two groove walls of the first docking groove 22. The limit block 44 can restrict the locking member 4 to only move between the locked position and the released position but not rotate. Each of the upper docking plate 56 and the lower docking plate 57 defines a notch 54 that avoids the limit block 44, such that the upper docking plate 56 and the lower docking plate 57 can still be inserted into the first docking groove 22 even with the limit block 44. Further, the notch 54 separates front ends of the upper docking plate 56 and the lower docking plate 57 into unevenly spaced segments, which may serve to distinguish between the front and rear ends of the docking member 5, and it is convenient for the user to connect the docking member 5 to the first docking groove 22 and to insert the locking member 5 into the locked position. The locking member 5 cannot be inserted when the locking member 5 is flipped over.

The locking member 4 is arranged with a third limiting portion 46, and the resilient member 45 is a coil spring sleeved on the second guide rod 43; the coil spring is compressed between the third limiting portion 46 and an inner wall of the first docking groove 22; an end of the spring abuts against the inner wall of the first docking groove 22, and the other end of the spring abuts against the third limiting portion 46, such that the first guide rod 42 can be provided with a force to penetrate the guide hole 23, thereby the first guide rod 42 can stably penetrate the guide hole 23 in a state of not being pressed. When the user releases the hand that presses the pressing portion 421, the locking member 4 will still rebound under the elastic force of the coil spring, and eject the first guide rod 42 out of the guide hole 23. The third limiting portion 46, which has a substantially same structure as the first limiting portion 41, can also be cooperated with the arcuate surface 551 of the second limiting portion 55 by means of the beveled surface.

The second docking member 52 has the same structure as the first docking member 51, the second docking mechanism 3 has the same structure as the first docking mechanism 2, and the connection method is the same, which will not be described in detail herein. The first docking member 51 is formed with a first articulation portion 511, and the second docking member 52 is formed with a second articulation portion 521, the first articulation portion 511 and the second articulation portion 521 being arranged in a relatively staggered manner. The first docking member 51 and the second docking member 52 are articulated with each other by means of an articulation shaft 53 passing through the first articulation portion 511 and the second articulation portion 521, where the articulation shaft 53 extends along the width direction of the bracelet body 1. This articulation structure may enable the first docking member 51 and the second docking member 52 to be oscillated along the articulation shaft 53, such that it is convenient for the user to adjust the shape and the angle of the weight-bearing bracelet.

Figure 12:
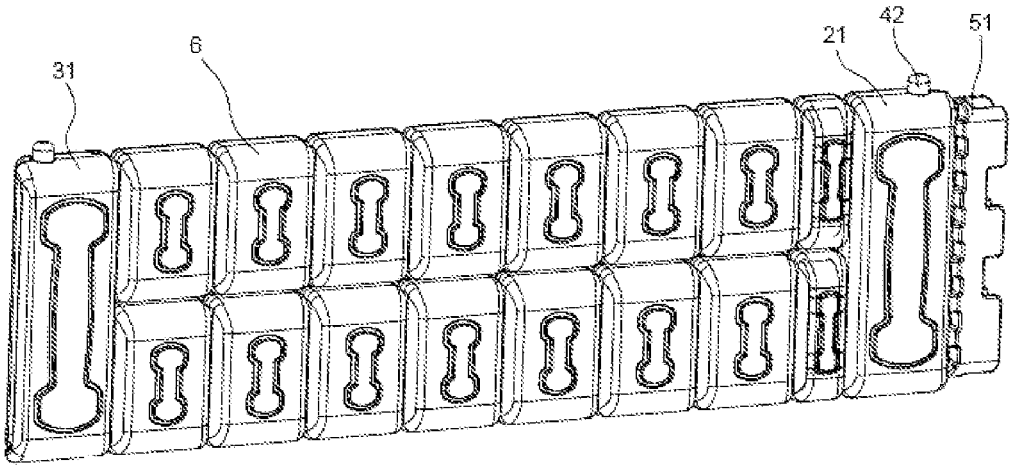
FIG. 12 is a perspective view of a weight-bearing bracelet in a disassembled state according to Embodiment II of the present disclosure.
Figure 13:
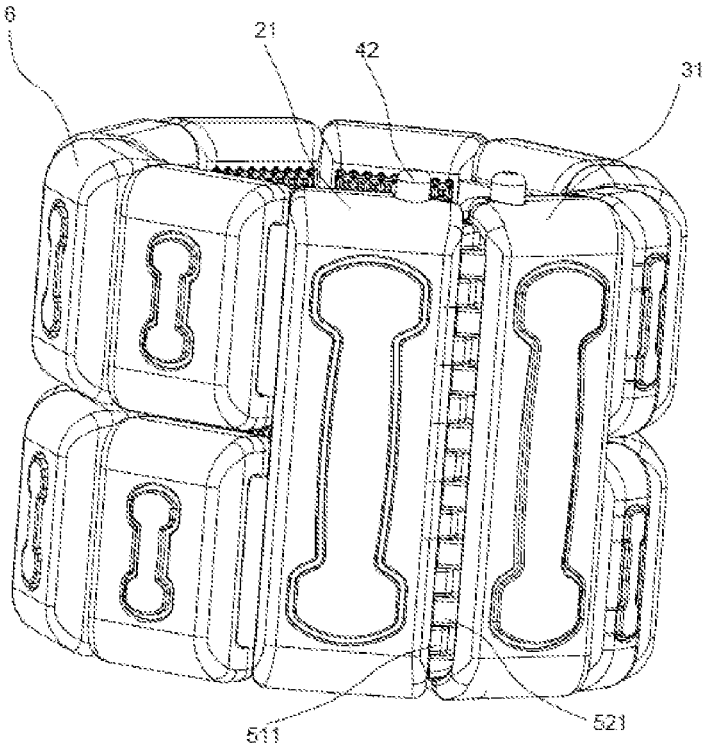
FIG. 13 is a perspective view of a weight-bearing bracelet in a connected state according to Embodiment II of the present disclosure.

Embodiment II: with reference to FIGS. 12 to 13, Embodiment II is substantially the same as Embodiment I. The difference is that Embodiment II employs a structure with double rows of small weight-bearing blocks 6 and double rows of band bodies, the use of which can be better adapted to changes in the hand. In use, the single-row weight-bearing block 12 in Embodiment 1 may be too wide for some users and cause a choking situation, and the use of a double-row structure allows the double-row small weight-bearing blocks to fit more snugly on the arm and increase a certain level of comfort.

The above is only some embodiments of the present disclosure, and it cannot be used to limit the scope of the present disclosure. That is, equivalent changes and modifications made in accordance with the scope of the present disclosure and the contents of the specification shall remain within the scope of the present disclosure.

What is claimed is:

1. A weight-bearing bracelet, comprising a bracelet body; wherein an end of the bracelet body is arranged with a first docking mechanism, and the other end of the bracelet body is arranged with a docking member; the first docking mechanism comprises a first docking groove and a locking assembly; the locking assembly comprises a locking member and a resilient member; the locking member is movably disposed between a locked position and a released position in the first docking groove, and the resilient member is configured to drive the locking member to move to the locked position; the locking member is arranged with first limiting portions; the docking member comprises a first docking member capable of being inserted into the first docking groove, and the first docking member is arranged with a second limiting portions; the second limiting in a condition that the first docking member is inserted into the first docking groove, the second limiting portions are located on a rear side of the first limiting portions to restrict the first docking member from being disengaged from the first docking groove.

2. The weight-bearing bracelet according to claim 1, wherein the locking member is movable in a width of the bracelet body; the locking member comprises a main body extending in the width of the bracelet body, the first limiting portions are formed on the main body and protrude out from upper and lower sides of the main body; the first docking member comprises an upper docking plate and a lower docking plate, the upper docking plate being arranged at an interval and opposite to the lower docking plate; the second limiting portions are formed on each inner surface of the upper docking plate and the lower docking plate that face each other other; the main body and the second limiting portions are located between the upper docking plate and the lower docking plate in the condition that the first docking member is inserted into the first docking groove.

3. The weight-bearing bracelet according to claim 2, wherein the main body of the locking member is further formed with a limit block adapted to the first docking groove, and the limit block is configured to restrict the locking member to only move between the locked position and the released position without rotating; each of the upper docking plate and the lower docking plate defines a notch that avoids the limit block.

4. The weight-bearing bracelet according to claim 3, wherein the notch of the upper docking plate and the lower docking plate separate front ends of the upper docking plate and the lower docking plate into unevenly spaced segments.

5. The weight-bearing bracelet according to claim 1, wherein the other end of the bracelet body is further arranged with a second docking mechanism, and the docking member further comprises a second docking member capable of being inserted into and cooperating with the second docking mechanism; the second docking member has a same structure as the first docking member, and the second docking mechanism has a same structure as the first docking mechanism.

6. The weight-bearing bracelet according to claim 5, wherein the bracelet body comprises a band body and a plurality of weight-bearing blocks sleeved on the band body.

7. The weight-bearing bracelet according to claim 6, wherein the first docking mechanism further comprises a first docking seat for defining the first docking groove; the first docking seat is connected to an end of the band body; the end of the band body is arranged with a restriction rod extending along a width of the band body, an end of the first docking seat defines the first docking groove, and another end of the first docking seat defines an avoidance hole in communication with the first docking groove; a length of the avoidance hole is adapted to the width of the band body, and a length of the restriction rod is greater than the width of the band body.

8. The weight-bearing bracelet according to claim 6, wherein the second docking mechanism comprises a second docking seat for defining the second docking groove; the second docking seat is arranged with two adjusting rods each extending along a width of the bracelet body; the two adjusting rods are arranged in parallel and spaced, and the band body is adjustably wound on the two adjusting rods.

9. The weight-bearing bracelet according to claim 5, wherein the first docking member and the second docking member are articulated with each other by means of an articulation shaft, the articulation shaft extending along a width of the bracelet body.

10. The weight-bearing bracelet according to claim 1, wherein the first docking mechanism comprises a docking seat for defining the docking groove; an end of the locking member is formed with a first guide rod extending from a length of the locking member, and another end of the locking member is formed with a second guide rod extending from the length of the locking member; the docking seat defines two guide holes for the first guide rod and the second guide rod to pass through; the first guide rod extends through a corresponding guide hole to an outer side of the docking seat in the condition of the locking member being in the locked position; the locking member is driven to move to the released position by the first guide rod being pressed.

11. The weight-bearing bracelet according to claim 10, wherein the locking member is further arranged with a third limiting portion, and the resilient member is a coil spring sleeved on the second guide rod; the coil spring is compressed between the third limiting portion and an inner wall of the first docking groove.

12. The weight-bearing bracelet according to claim 1, wherein a length of the first docking groove extends along a width of the bracelet body; a width of the first docking groove extends along a thickness of the bracelet body; a size of the first docking member and a size of the first docking groove are adapted to match.

13. The weight-bearing bracelet according to claim 12, wherein a cross-section of the first docking groove is substantially trapezoidal in shape.

14. The weight-bearing bracelet according to claim 1, wherein the first limiting portions are formed with a guiding bevel, and the second limiting portions are capable of being guided by the guiding bevel to the rear side of the first limiting portions.

* * * * *